United States Patent [19]

Radzins et al.

[11] 4,108,584

[45] Aug. 22, 1978

[54] FLUFF DISTRIBUTOR

[75] Inventors: Edmund A. Radzins, Sheboygan Falls; Gene F. Kiela, Kohler, both of Wis.

[73] Assignee: Curt G. Joa, Inc., Sheboygan Falls, Wis.

[21] Appl. No.: 759,954

[22] Filed: Jan. 17, 1977

[51] Int. Cl.[2] ..... B29C 13/00

[52] U.S. Cl. ..... 425/83.1; 425/141; 425/145; 425/147; 425/217

[58] Field of Search ..... 425/81, 83, 145, 217, 425/218, 141, 147; 264/112, 113

[56] References Cited

U.S. PATENT DOCUMENTS

| | | | |
|---|---|---|---|
| 2,568,332 | 9/1951 | Genovese | 425/147 |
| 2,988,469 | 6/1961 | Watson | 425/83 X |
| 3,086,253 | 4/1963 | Joa | 425/81 X |
| 3,167,811 | 2/1965 | Kraus et al. | 425/217 |
| 3,271,817 | 9/1966 | Kanbar | 425/147 |
| 3,932,080 | 1/1976 | Uemura et al. | 425/326 R X |

*Primary Examiner*—Robert L. Spicer, Jr.
*Attorney, Agent, or Firm*—Joseph P. House, Jr.

[57] ABSTRACT

A fluff distributor comprises a fluff chamber, two or more vacuum screens in said chamber and onto which screens fluff is laid in batts. The screens have separately controllable drive mechanism whereby each screen can be independently driven at a desired rate of speed. Accordingly, the volume of fluff output from said chamber for each screen is similarly separately controllable. Each screen supplies fluff to one of several converting machines. The converting machines can operate at different rates of speed requiring different volumes of fluff and by reason of the separate control for each distributor screen, the same fluff distributor can supply fluff to different converting machines operating at different demand levels for fluff.

10 Claims, 5 Drawing Figures

FLUFF DISTRIBUTOR

BACKGROUND OF THE INVENTION

It is old to supply fluff to a converting machine through a fluff batt forming and feeding machine having a single screen. See, for example, Joa U.S. Pat. Nos. 3,086,253 and 3,666,611. It is also old to utilize such a machine to reclaim waste pulp and fluff and to mix the output of said reclaiming machine with fluff generated from a virgin source of fluff for joint delivery to a converting machine. However, in such prior devices, each converting machine required its own waste reclaiming fluff feeder. In a converting plant having several converting machines with each requiring its own feeder for reclaimed fluff, the high cost of the machinery, the large floor spaced required and the power demands of the several reclaimers have militated against the utilization of reclaimed fluff.

SUMMARY OF THE INVENTION

In accordance with the present invention, a single reclaimed fluff feeder is provided with multiple, separately driven screens, each one serving its own converting machine. Accordingly, a single reclaimed fluff feeder can service a plurality of converting machines, thus greatly reducing the capital investment, floor space and energy which would otherwise be required for utilizing and recycling waste pulp and fluff.

In accordance with the present invention, a fluff distributor is provided and which comprises a fluff chamber with a plurality of vacuum screens onto which screens reclaimed fluff is laid in batts. There are separately controllable drive mechanisms for each screen whereby each screen can be independently driven at a desired rate of speed whereby the volume of fluff output from said chamber for each screen is similarly separately controllable. Each screen furnishes reclaimed fluff to its own converting machine which is also supplied with fluff from a virgin source. Proportioning and distribution control mechanism is provided whereby the screen speed and hence the quantity of reclaimed fluff for each converting machine is varied in response to the demand of said converting machine for fluff. The control mechanism proportions the fluff supplied to each converting machine from a virgin source at a predetermined ratio to the quantity of reclaimed fluff supplied by the fluff distributor.

Mechanism is also provided to sense a deficiency of fluff on the screens in the fluff distributor, whereupon the fluff distributor will be disconnected from the system and the ratio selector will function to supply the converting machines with 100% virgin fluff. Reclaimed fluff will then be bypassed from the output of the fluff distributor to its input. When the sensing mechanism in the fluff distributor senses an adequate supply of reclaimed fluff, the fluff distributor will be reconnected to the converting machines and the ratio selector will reduce the amount of virgin fluff to the desired ratio of virgin fluff and reclaimed fluff.

Otherobjects, features and advantages of the invention will appear from the disclosure hereof.

DESCRIPTION OF THE DRAWINGS

FIG. 2 is a view partly in top plan and horizontal cross section through the apparatus of FIG. 1.

DESCRIPTION OF THE PREFERRED EMBODIMENT

Figure 1:
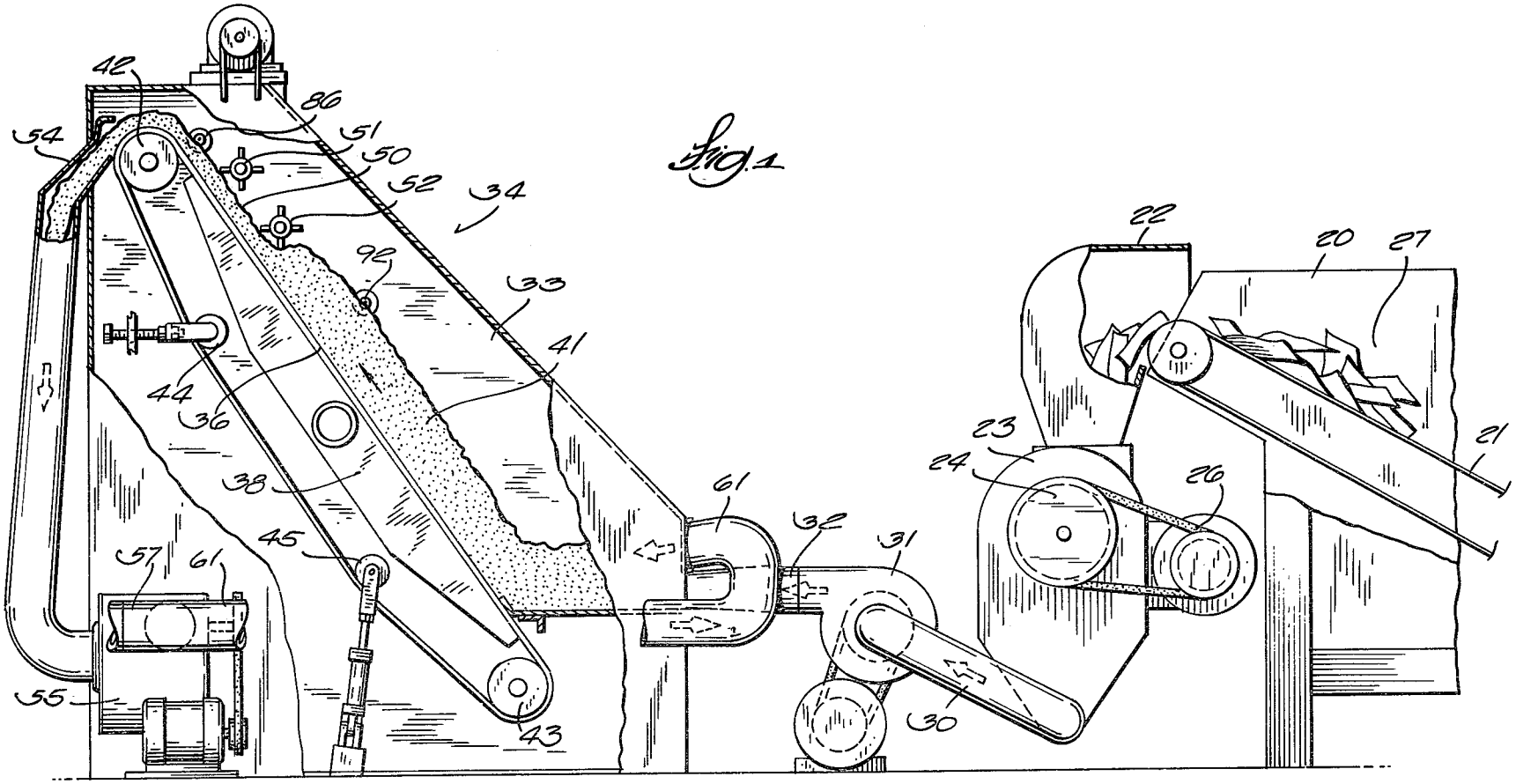
FIG. 1 is a side view, partly in elevation and partly in vertical cross section, through a fluff distributor and its hopper feeder and embodying the invention.
Figure 12:
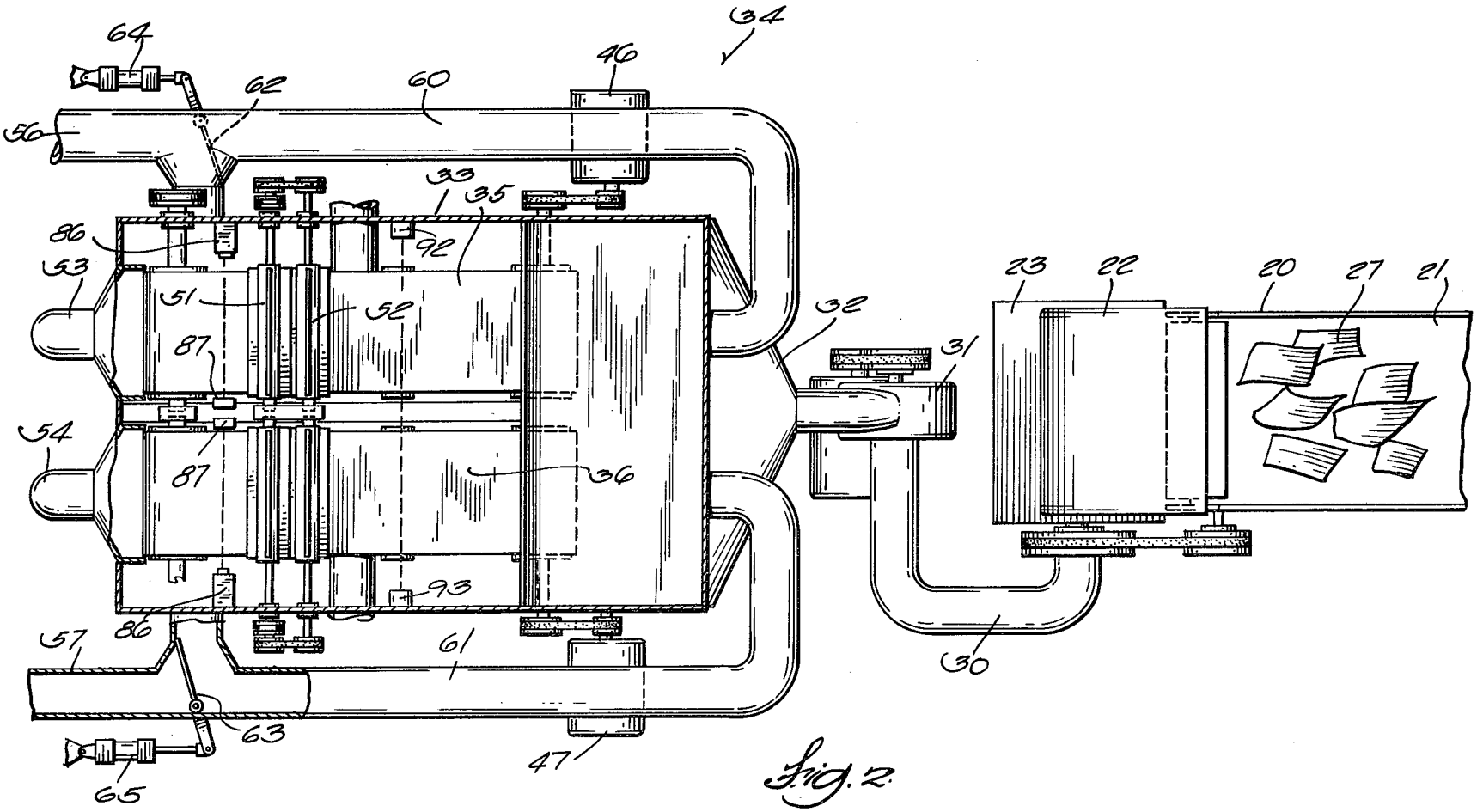

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

The fluff generated and utilized by the apparatus herein illustrated is typically fluff used for the absorbent fillers of sanitary pads, such as sanitary napkins, diapers, hospital pads, bandages, etc. Joa U.S. Pat. No. 3,666,611 illustrates a converting machine incorporating disposable diaper fabricating apparatus of the type above referred to. Two such disposable diaper fabricating machines 10, 11 are illustrated diagrammatically in FIG. 4.

Virgin fluff is supplied to the converting machines 10, 11 from any conventional pulp source thereof, for example, rolled stock 12, 13 of pulpboard which are defiberized in the fluff generators 14, 15. These can incorporate the structures of Joa U.S. Pat. Nos. 3,268,954 and 3,538,551. The fluff output from the generators 14, 15 is supplied in batt form to the converting machines 10, 11 through volumetric feeders 16, 17. These desirably incorporate the structures of the several Joa U.S. patents hereinbefore mentioned.

As hereinbefore indicated, it is frequently desired from an engineering and materials and energy conservation standpoint to utilize waste fluff, pulp, etc., which is generated in converting plants, as for example from clean reject products, for mixture with the virgin fluff supplied by the generators 14, 15. The prior art has utilized this technique by employing apparatus fabricated by applicant in which the waste fluff, pulp stock, cellulose wadding, plastic film, etc., is comminuted and mixed with the virgin fluff output of the generators 14, 15. However, in the prior art, a separate waste reclaimer is required for each converting machine, with the disadvantages hereinbefore mentioned.

In accordance with the present invention, a single waste reclaimer will serve a plurality of converting machines such as is typified by the two converting machines 10, 11 of the instant drawings.

As shown in the drawings, waste fluff, pulp, etc. 27 is deposited in the hopper 20 and is fed by endless belt 21 into an intake hood 22 of a hammer mill or similar fluff generator 23. Generator 23 has a rotor 24 driven by motor 26. Reclaimed fluff thus generated is pneumatically conveyed through the pipe 30 to the inlet eye of blower 31 which blows the fluff through the distribution manifold 32 into the chamber 33 of the fluff distributor 34. Fluff distributor 34 has elements similar to those of the volumetric feeder shown in Joa U.S. Pat. No. 3,086,253, except for important differences which adapt the apparatus to service a plurality of converting machines at rates of supply based upon the demand of said converting machines for reclaimed fluff.

Feeder 34 is provided with as many vacuum screens as there are converting machines 10, 11. In the embodiment disclosed herein to exemplify the invention, there are two such screens 35, 36. The respective screens 35, 36 travel over vacuum boxes 37, 38 so that the runs of the screens 35, 36 which are exposed to the chamber 33 will provide a surface upon which reclaimed fluff 41 will be drawn to form a relatively thick batt or mat of fluff, as shown in FIG. 1.

Each screen 35, 36 is trained about a top end roller 42 and a bottom end roller 43 and the screen is tightened by idler rollers 44, 45. The bottom rollers 43 for the respective screens 35, 36 are driven by separately controlled electric motors 46, 47. Accordingly, the speed of each screen 35, 36 can be varied in accordance with the speed of the motors 46, 47.

The thickness of the batts 50 on the screens 35, 36 is established by rotating paddle reels 51, 52 so that batts 50 of uniform thickness can be stripped off of the ends of the screens 35, 36 as they bend around the top rollers 42. With a uniform batt thickness, the volume or quantity of fluff delivered by each screen 35, 36 varies directly with screen speed.

Figure 3:
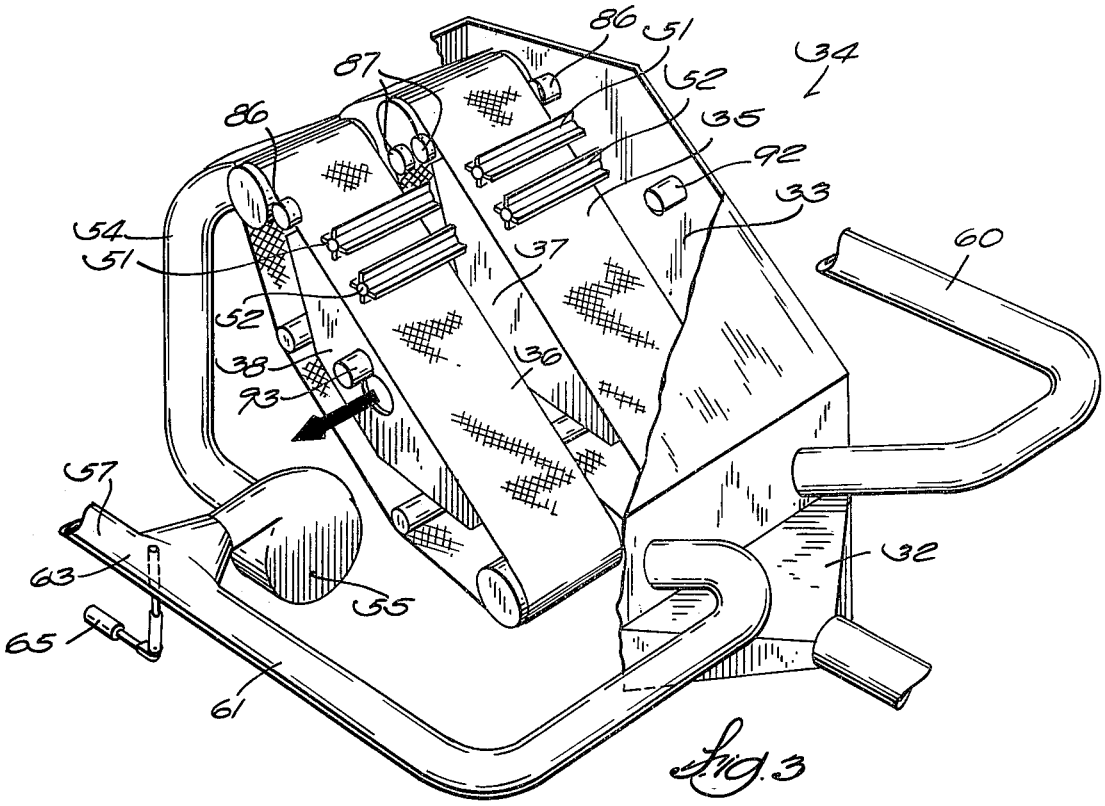
FIG. 3 is a fragmentary diagrammatic perspective view of the fluff distributor of FIGS. 1 and 2 with portions cut away to expose internal details.

The batt 50 from screen 35 is fed into a pneumatic discharge pipe 53. Batt 50 from screen 36 is fed into pneumatic discharge pipe 54. The respective pipes 53, 54 feed reclaimed fluff into the eyes of blowers 55, one at each side of the feeder 34 and only one of which is shown in FIG. 3, the other one being concealed in this figure behind the feeder. The output of the respective blowers 55 is selectively fed into pneumatic conveyor ducts 56, 57 which extend respectively to the volumetric feeder chambers 16, 17 of the converting machines 10, 11, or alternatively, to the bypass pneumatic ducts 60, 61 which return the fluff to the fluff chamber 33 of feeder 34.

In order to alternatively direct the fluff as between the pneumatic conveyor ducts 56, 57 and the bypass ducts 60, 61, the outlet of each blower 55 is provided with one of the gate valves 62, 63. These are best shown in FIG. 2 of the drawings. In FIG. 2, valve 63 is shown in its position in which the reclaimed fluff output of screen 36 is recycled through bypass duct 61 back to the chamber 33. Gate valve 62 is shown in its position in which the output from screen 35 is delivered through the pneumatic duct 56 to the volumetric feeder 16 of converting machine 10.

The respective gate valves 62, 63 are operated by conventional apparatus such as the air cylinders 64, 65. Cylinders 64, 65 are controlled by air valves 66, 67 (FIG. 4) in a manner hereinafter described.

As hereinbefore indicated, the volumetric feeders 16, 17 of the converting machines 10, 11 are provided with virgin fluff from the respective fluff generators 14, 15. The rate of feed of pulpboard stock 12, 13 to the generators 14, 15 is controlled by drive mechanism including paired feed rollers 68 for generator 14 and paired feed rollers 71 for generator 15. Drive rollers 68 are driven by a belt drive unit 72 and the drive rollers 71 for fiberizer 15 are driven by a belt drive unit 73. The respective drive units 72, 73 are provided with speed controllers 74, 75 as hereinafter explained.

Figure 5:
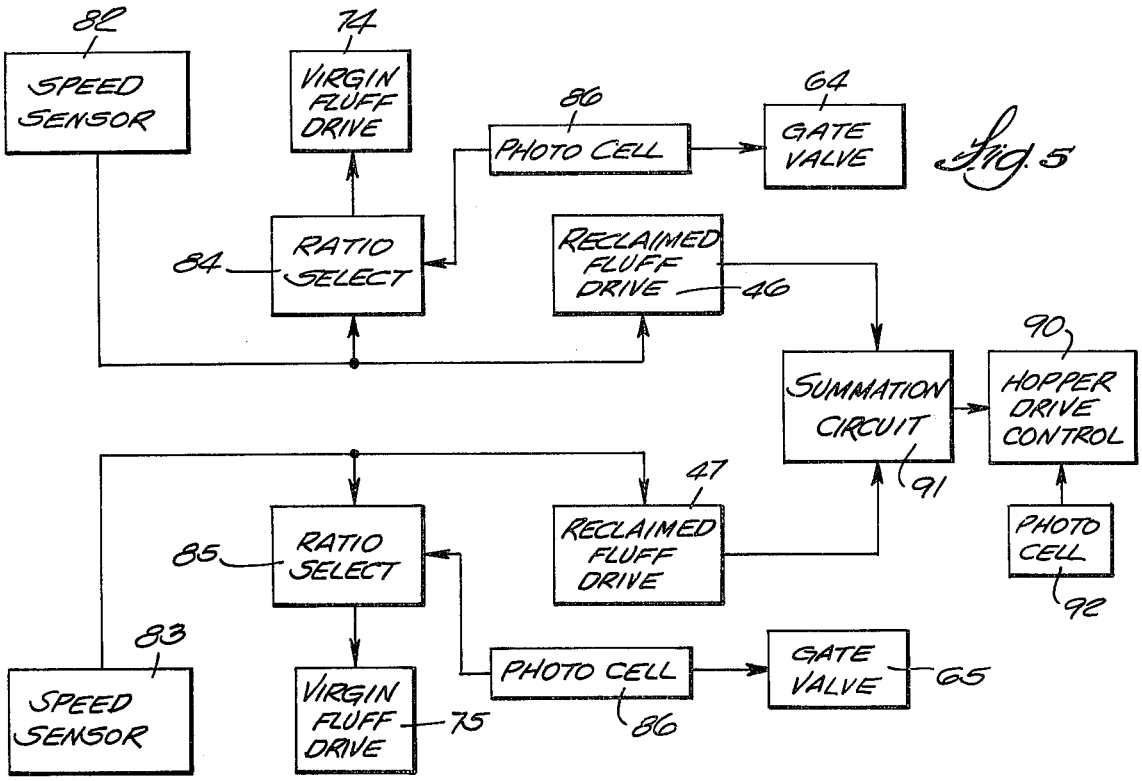
FIG. 5 is a schematic circuit diagram for the control mechanism of apparatus embodying the invention.
Figure 4:
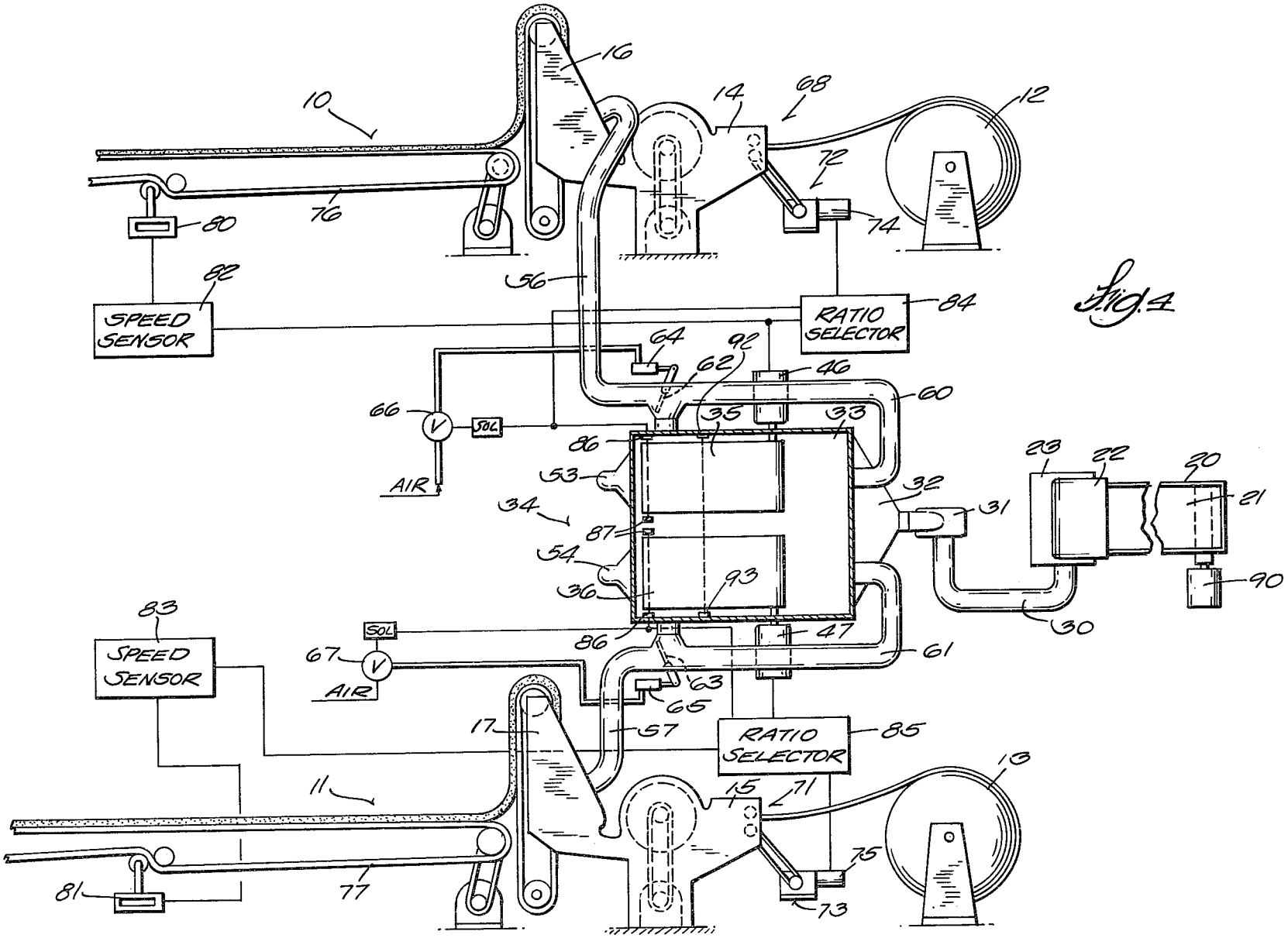
FIG. 4 is a schematic view illustrating the utilization of the fluff distributor of FIGS. 1 and 2 with two converting machines, each having its own supply of virgin fluff.

The control circuitry is illustrated schematically in FIGS. 4 and 5. Converting machines 10, 11 typically comprise belts 76, 77. The speed of these belts 76, 77 will vary from one converting machine to another, depending upon various conditions of production. Accordingly, the demand of the respective converting machines 10, 11 for fluff will vary from one machine to the other. This demand is sensed by tachometers 80, 81 which signal speed sensing apparatus 82, 83. The speed sensors 82, 83 signal ratio selectors 84, 85, one for each converting machine 10, 11. The ratio selectors function to regulate the supply of fluff to the volumetric feeders 16, 17 for each converting machine 10, 11 in a desired proportion between virgin fluff generated by the generators 14, 15 and reclaimed fluff supplied by the respective screens 35, 36 of the waste reclaimer 34.

Typically, the desired ratio is 80% virgin fluff and 20% reclaimed fluff, although other ratios appropriate for the ultimate product of the converting machines 10, 11 can be selected. Accordingly, the ratio selectors 84, 85 signal the speed controllers 74, 75 of the pulp drive rollers 68, 71 to maintain a ratio of 80% virgin pulp to 20% reclaimed fluff, or any other desired ratio. If, for example, the speed of belt 76 of converting machine 10 drops because of a temporary slowdown of this particular machine, its tachometer 80 and speed sensor 82 will signal the ratio selector 84 which will, in turn, signal the controller 74 for pulp sheet drive 68 to reduce the quantity of pulp fed into the generator 14 and will also signal the controller for motor 46 which drives the screen 35, thus to reduce the speed of screen 35 in the same proportion as the speed of the pulp drive rollers 68 is reduced, thus to maintain the 80:20 per cent ratio between virgin fluff and reclaimed fluff.

When the speed of the belt 76 of converting machine 10 increases, thus reflecting a greater demand for fluff, corresponding signals will be sent by the speed sensor 80 to the ratio selector 84 and the screen drive controller for motor 46 to concurrently increase the speed of the pulp drive rollers 68 and the screens 35.

There may be conditions in the fabricating plant pursuant to which there is a shortage of waste product 27 so that the desired 80:20 ratio between virgin fluff and reclaimed fluff cannot be maintained. In this circumstance, the control circuitry herein disclosed will discontinue supply of reclaimed fluff from the waste reclaimer 34 and the ratio selectors 84, 85 will signal the virgin fluff generators 14, 15 to supply 100% virgin fluff to the volumetric feeders 16, 17. For this purpose the waste reclaimer 34 is provided with level sensing mechanism which senses the thickness of the batts 50 on the screens 35, 36.

In the disclosed embodiment, this sensing apparatus comprises paired light sources 87 and photocells 86, as shown in FIGS. 1, 2 and 3. The light beams therebetween are arranged at a predetermined spacing from the screens 35, 36, for example, 1 inch. So long as the supply of reclaimed fluff 41 to the screens 35, 36 is sufficient to maintain batts 50 at the 1 inch thickness, reclaimer 34 will continue to function to supply all of the reclaimed fluff demands of the converting machines 10, 11, at the 80:20% ratio. However, if the supply of reclaimed fluff is insufficient to maintain a 1 inch depth of batt 50 on one or the other or both of screens 35, 36 or for any other reason the thickness of batt 50 drops below 1 inch on one or the other or both of screens 35, 36, the photocell 86 for the screen deficient in fluff will sense the reduction in batt thickness and will send a signal to its ratio selector 84 or 85 to change the ratio of 80:20 to 100% virgin fluff for the converting machine serviced by the screen 35, 36 which has a deficiency of reclaimed fluff. At the same time, said photocell 86 will signal its air valve 66 or 67 to actuate the appropriate air cylinder 64 or 65 to swing the appropriate gate valve 62 or 63 to its position which will block the appropriate pneumatic duct 56 or 57 and bypass fluff from the appropriate output or discharge duct 53 or 54 back through the appropriate bypass ducts 60 or 61 to the inlet of the chamber 33 of the waste distributor 34.

As soon as the supply of reclaimed fluff 41 builds up to an adequate level to restore the thickness of deficient batt 50 to a point where the batt breaks the light beam from light source 87 to its photocell 86, the photocell will again signal the appropriate air valve 66 or 67 to swing appropriate gate 62 or 63 to its opposite position to discontinue bypassing waste fluff and to transmit this fluff to the appropriate volumetric feeder 16 or 17 and also will signal the appropriate ratio selector 84 or 85 to reduce the speed of the appropriate pulp drive unit 68 or 71 and restore the ratio of virgin fluff to reclaimed fluff to the 80:20 ratio. Accordingly, both screens 35, 36 can be feeding reclaimed fluff to the converting machines 10, 11, both can be bypassing fluff, or one can be feeding and the other can be bypassing, depending upon conditions.

The disclosed apparatus will function when all converting machines are operating, even though at different demand levels. When one converting machine stops entirely, its screen in the waste reclaimer 34 will operate at minimum speed and the output of said screen will bypass or recycle back to the chamber 33, in readiness to resume delivery to the idle converting machine when it resumes operation.

In order to prevent overloading the input to the distributor 34 during low demand periods, the drive mechanism 90 (FIGS. 4 and 5) for its feed belt 21 is controlled by a speed controller including summation circuit 91 which responds to the speed of the distributor screens 35, 36. Photocell 92 receives light from light source 93. Light source 93 and photocell 92 are mounted across the screens 35, 36 at a spacing therefrom beyond which the screens will be overloaded. Summation circuit adds the speeds of the two screens 35, 36 and signals the drive mechanism 90 in proportion to said sum. Accordingly, if the demand is low, with corresponding low speed of one or both screens 35, 36, this summation circuit will slow down the hopper drive mechanism 90, thus to prevent overloading the distributor 34. If the amount of fluff 41 becomes excessive in the distributor 34, the photocell 92 signals the drive control 90 for feed belt 21 to stop. When the fluff 41 reduces in volume, the photocell 92 signals the drive control 90 for feed belt 21 to start feeding.

We claim:

1. A fluff distributor for supplying a plurality of converting machines operable at different rates of speed requiring different volumes of fluff, said fluff distributor comprising a fluff chamber, a plurality of vacuum screens in said chamber and onto which screens fluff is laid in batts, separately controllable drive mechanism for said screens whereby each screen can be independently driven at the same or different desired rates of speed whereby the volume of fluff output from said chamber for each said screen is similarly separately controllable.

2. The fluff distributor of claim 1 in which said screens are provided with leveling means for leveling the batt thickness on the screens to a predetermined amount.

3. The fluff distributor of claim 1 in combination with a fluff output conveyor from each screen to a converting machine and a fluff bypass conveyor from the output of said screens back to said chamber and valve means to selectively direct said fluff to said fluff output conveyor for utilization of said fluff by said converting machine or to said fluff bypass conveyor to recycle fluff through said chamber.

4. The fluff distributor of claim 3 in combination with control means for said valve means, said control means comprising a batt level sensor means for actuating said valve to direct said fluff to said fluff output conveyor when the batt level reaches a predetermined level and for actuating said valve to direct said fluff to said fluff bypass conveyor when the batt level drops below a predetermined level.

5. The fluff distributor of claim 4 in which said batt level sensor comprises a photocell.

6. A fluff distributor comprising a fluff chamber, a plurality of vacuum screens in said chamber and onto which screens fluff is laid in batts, separately controllable drive mechanism for said screens whereby each screen can be independently driven at a desired rate of speed whereby the volume of fluff output from said chamber for each said screen is similarly separately controllable, a fluff output conveyor from each screen to a converting machine with a fluff bypass conveyor from the output of said screens back to said chamber and valve means to selectively direct said fluff to said fluff output conveyor for utilization of said fluff by said converting machine or to said fluff bypass conveyor to recycle fluff through said chamber, a separate source of fluff for each converting machine and control means for proportioning fluff fed to the converting machine at various desired ratios of fluff from said separate source and said fluff distributor.

7. The combination of claim 6 in which each said separate source of fluff has a drive mechanism, said control means including a ratio selector and a batt level sensor means for concurrently actuating said ratio selector and said bypass valve whereby to furnish fluff entirely from said separate source when said bypass valve recycles fluff.

8. The fluff distributor of claim 1 in combination with a fluff source feeding fluff to said distributor and means for controlling the output of said fluff source.

9. The device of claim 8 in which the means for controlling the output of said fluff source comprises fluff level sensing means in said distributor.

10. A fluff distributor comprising a fluff chamber, a plurality of vacuum screens in said chamber and onto which screens of fluff is laid in batts, separately controllable drive mechanism for said screens whereby each screen can be independently driven at a desired rate of speed whereby the volume of fluff output from said chamber for each said screen is similarly separately controllable, a fluff source feeding fluff to said distributor and means for controlling the output of said fluff source comprising drive means responsive to the summation of the speeds of the said screens.

* * * * *